US011767486B2

(12) United States Patent
Ootsuki et al.

(10) Patent No.: US 11,767,486 B2
(45) Date of Patent: Sep. 26, 2023

(54) SULFUR-BASED EXTREME-PRESSURE AGENT AND METALWORKING FLUID

(71) Applicant: DIC Corporation, Tokyo (JP)

(72) Inventors: Shuujirou Ootsuki, Kamisu (JP); Takafumi Iba, Kamisu (JP); Hiroshi Sakata, Kamisu (JP)

(73) Assignee: DIC CORPORATION, Tokyo (JP)

( * ) Notice: Subject to any disclaimer, the term of this patent is extended or adjusted under 35 U.S.C. 154(b) by 0 days.

(21) Appl. No.: 17/417,246

(22) PCT Filed: Dec. 12, 2019

(86) PCT No.: PCT/JP2019/048661
§ 371 (c)(1),
(2) Date: Jun. 22, 2021

(87) PCT Pub. No.: WO2020/158205
PCT Pub. Date: Aug. 6, 2020

(65) Prior Publication Data

US 2022/0073835 A1 Mar. 10, 2022

(30) Foreign Application Priority Data

Jan. 29, 2019 (JP) ..... 2019-013057

(51) Int. Cl.

| | |
|---|---|
| ***C10M 135/22*** | (2006.01) |
| ***C10N 20/04*** | (2006.01) |
| ***C10N 30/06*** | (2006.01) |
| ***C10N 40/20*** | (2006.01) |

(52) U.S. Cl.
CPC .... *C10M 135/22* (2013.01); *C10M 2219/024* (2013.01); *C10M 2219/082* (2013.01); *C10M 2223/041* (2013.01); *C10N 2020/04* (2013.01); *C10N 2030/06* (2013.01); *C10N 2040/20* (2013.01)

(58) Field of Classification Search
CPC ..... C10M 135/22; C10M 2219/024; C10M 2219/082; C10M 2223/041; C10N 2020/04; C10N 2030/06; C10N 2040/20
See application file for complete search history.

(56) References Cited

U.S. PATENT DOCUMENTS

| | | | | |
|---|---|---|---|---|
| 5,877,130 | A | 3/1999 | Kohara et al. | |
| 5,908,816 | A | 6/1999 | Kobessho et al. | |
| 10,487,285 | B2 | 11/2019 | Iba et al. | |
| 2004/0242440 | A1* | 12/2004 | Okuda | C10M 141/08 508/567 |
| 2019/0106653 | A1* | 4/2019 | Kitamura | C10M 129/92 |

FOREIGN PATENT DOCUMENTS

| | | | |
|---|---|---|---|
| CN | 107406797 | A | 11/2017 |
| CN | 109072116 | A | 12/2018 |
| JP | 6-313182 | A | 11/1994 |
| JP | 6-330076 | A | 11/1994 |
| JP | 10-226795 | A | 8/1998 |
| JP | 2969280 | B2 | 11/1999 |
| JP | 2003-055679 | A | 2/2003 |
| JP | 2003-73684 | A | 3/2003 |
| JP | 2004-59658 | A | 2/2004 |
| JP | 2012-197329 | A | 10/2012 |
| JP | 2015-74694 | A | 4/2015 |
| JP | 2016-079383 | A | 5/2016 |
| WO | 2015/046008 | A1 | 4/2015 |
| WO | 2016/158534 | A1 | 10/2016 |

OTHER PUBLICATIONS

International Search Report dated Mar. 10, 2020, issued in counterpart International Application No. PCT/JP2019/048661 (2 pages).
Office Action dated Mar. 30, 2022, issued in counterpart CN Application No. 201980088831.X, with English Translation. (20 pages).
Office Action dated Feb. 1, 2023, issued in counterpart IN Application No. 202117038980, with English Translation. (6 pages).

* cited by examiner

*Primary Examiner* — James C Goloboy
(74) *Attorney, Agent, or Firm* — WHDA, LLP

(57) ABSTRACT

In metalworking, the amount of sulfur supplied is stabilized in wide temperature and pressure ranges and under an external force, such as a shear force. Thus, a stable iron sulfide film can be formed on the metal surface, and lubricity can be maintained for extended periods. Furthermore, a bulky sulfurized fat or oil with a high molecular weight can be used to form a rigid lubricating oil film with a large oil film thickness on the metal surface and thereby prevent metals from approaching each other. A sulfur-based extreme-pressure agent containing a polysulfide (a) and a sulfurized fat or oil (b) at a mass ratio in the range of 1:0.1 to 1:10. A metalworking fluid containing the sulfur-based lubricating oil composition is also related to.

5 Claims, No Drawings

SULFUR-BASED EXTREME-PRESSURE AGENT AND METALWORKING FLUID

TECHNICAL FIELD

The present invention relates to a sulfur-based extreme-pressure agent and a metalworking fluid.

BACKGROUND ART

In metalworking, such as cutting and deformation processing, various metalworking fluids are conventionally used to facilitate the working. These metalworking fluids typically contain a base oil, such as a mineral oil, fat or oil, or synthetic oil, mixed with various additives, such as a chlorine-based extreme-pressure agent, a sulfur-based extreme-pressure agent, a phosphorus-based extreme-pressure agent, an organometallic compound based extreme-pressure agent, an oiliness agent, an antioxidant, an anticorrosive, a corrosion inhibitor, an anti-foaming agent, and/or a nonferrous metal anticorrosive. Among these extreme-pressure agents, chlorine-based extreme-pressure agents are particularly widely used due to their good cutting performance and relatively low costs. More specifically, chlorinated paraffins, chlorinated fatty acids, chlorinated fatty acid esters, and the like have been widely used as chlorine-based extreme-pressure agents.

The use of metalworking fluids containing a chlorine-based extreme-pressure agent, however, may cause the problems of environmental pollution due to dioxin emission during incineration and the corrosion and damage to incinerators due to chlorine gas evolution. There is also a concern that among the chlorine-based extreme-pressure agents some chlorinated paraffins may be toxic and carcinogenic. Furthermore, chlorine-based extreme-pressure agents cause rust and therefore need cleaning immediately after working. Thus, the use of chlorine-based extreme-pressure agents is complicated. Thus, in recent years, metalworking fluids free of chlorine-based extreme-pressure agents have been under development.

Some known chlorine-free metalworking fluids contain a sulfur-based additive, such as a polysulfide, a sulfurized fat or oil, calcium sulfonate, or ZnDTP, or a phosphorus-based additive, such as a phosphate ester (Patent Literature 1 to Patent Literature 5).

CITATION LIST

Patent Literature

PTL 1: Japanese Unexamined Patent Application Publication No. 6-313182

PTL 2: Japanese Unexamined Patent Application Publication No. 6-330076

PTL 3: Japanese Unexamined Patent Application Publication No. 10-226795

PTL 4: Japanese Unexamined Patent Application Publication No. 2004-059658

PTL 5: Japanese Unexamined Patent Application Publication No. 2003-073684

Although there have been demands for metallic materials with higher hardness and working with higher efficiency in recent years, these metalworking fluids have insufficient workability, which decreases tool life and working accuracy. Thus, there is a demand for metalworking fluids with high workability.

SUMMARY OF INVENTION

Technical Problem

It is an object of the present invention to provide a sulfur-based extreme-pressure agent that can satisfy recent advanced requirements in metalworking and a metalworking fluid containing the sulfur-based extreme-pressure agent. Extreme-pressure agents are additives that react chemically with metal surfaces at the time of friction between two metal surfaces, form a lubricant film, and prevent seizing. The temperature and pressure around the friction surfaces vary widely. Furthermore, extreme-pressure agents are subjected to external forces, such as shear. It is an object of the present invention to provide a sulfur-based extreme-pressure agent that can form a rigid lubricating oil film with a large oil film thickness on a metal surface even in wide temperature and pressure ranges and under an external force, such as a shear force, and that can maintain lubricity for extended periods, and a metalworking fluid containing the sulfur-based extreme-pressure agent.

Solution to Problem

The present inventors have made extensive studies in view of the above circumstances and have completed the present invention by finding that a metalworking fluid containing a sulfur-based extreme-pressure agent containing a polysulfide (a) and a sulfurized fat or oil (b) at a weight ratio in the range of 1:0.1 to 1:10 can maintain lubricity for extended periods even in wide temperature and pressure ranges and under an external force, such as a shear force.

The present invention relates to:

1. a sulfur-based extreme-pressure agent containing a polysulfide (a) represented by the following formula (1) and a sulfurized fat or oil (b) at a weight ratio in the range of 1:0.1 to 1:10, $$R^1—S_x—R^2 \quad (1)$$

wherein $R^1$ and $R^2$ denote an alkyl or alkenyl group having 2 to 24 carbon atoms, and x denotes an integer in the range of 1 to 8;

2. the sulfur-based extreme-pressure agent, wherein the polysulfide (a) is a polysulfide (a) composed of a tertiary polysulfide and a secondary polysulfide at a weight ratio in the range of 1:0.2 to 1:5;

3. the sulfur-based extreme-pressure agent, wherein the sulfurized fat or oil (b) has a weight-average molecular weight in the range of 1000 to 100,000; and 4. a metalworking fluid containing 1% to 100% by weight of the sulfur-based extreme-pressure agent according to any one of the above 1 to 3.

Advantageous Effects of Invention

A sulfur-based extreme-pressure agent and a metalworking fluid containing the sulfur-based extreme-pressure agent according to the present invention can form a rigid lubricating oil film with a large oil film thickness and a stable iron sulfide film on the metal surface even in wide temperature and pressure ranges and under an external force, such as a shear force, can maintain load bearing performance and lubricity for extended periods, and have particularly remarkable technical advantages that thermal discoloration and oil stain do not occur, rust and corrosion do not occur, and load on the human body and the environment can be reduced.

DESCRIPTION OF EMBODIMENTS

The present invention provides a sulfur-based extreme-pressure agent and a metalworking fluid containing the sulfur-based extreme-pressure agent.

A sulfur-based extreme-pressure agent according to the present invention contains a particular polysulfide and a particular sulfurized fat or oil.

<Polysulfide>

A polysulfide according to the present invention is a compound with the structure represented by the following general formula (1). The compounds represented by the general formula (1) are classified into primary polysulfides, secondary polysulfides, and tertiary polysulfides in accordance with their structures.

$$R^1—S_x—R^2 \quad (1)$$

In the general formula (1), $R^1$ and $R^2$ independently denote a linear or branched alkyl or alkenyl group having 2 to 24 carbon atoms, and x denotes an integer in the range of 1 to 8.

Examples of the primary polysulfides include diethyl polysulfide, di-n-butyl polysulfide, di-n-hexyl polysulfide, di-n-octyl polysulfide, di-n-nonyl polysulfide, di-n-dodecyl polysulfide, and di-n-octadecyl polysulfide.

Examples of the secondary polysulfides include bishexan-2-yl polysulfide, bisoctan-2-yl polysulfide, bisdecen-2-yl polysulfide, and bisdodecen-2-yl polysulfide. Among them, bisdecen-2-yl polysulfide is preferable from the perspective of the balance between the sulfur content, load bearing performance, and lubricity.

Examples of the tertiary polysulfides include bis-2-methylethan-2-yl polysulfide, bis-2-methylpentan-2-yl polysulfide, bis-2-methylhexan-2-yl polysulfide, bis-2-methylheptan-2-yl polysulfide, bis-2-methylnonan-2-yl polysulfide, bis-2-methylundecen-2-yl polysulfide, and bis-2,4,4-trimethylpentan-2-yl polysulfide. Among them, bis-2,4,4-trimethylpentan-2-yl polysulfide is preferable from the perspective of the balance between the sulfur content, load bearing performance, and lubricity and the availability of raw materials.

When the polysulfide is used as an additive for a metalworking fluid, such as an extreme-pressure agent, the sulfur content of the polysulfide preferably ranges from 10% to 60% by weight, particularly preferably 10% to 50% by weight, from the perspective of good load bearing performance of the metalworking fluid.

The polysulfide typically has a viscosity in the range of 5 to 1000 $mm^2/s$, preferably 10 to 500 $mm^2/s$, particularly preferably 10 to 200 $mm^2/s$, based on kinematic viscosity at 40° C., from the perspective of high compatibility with a base oil described later and ease of handling.

The polysulfide in the present invention may be a primary polysulfide, a secondary polysulfide, a tertiary polysulfide, or a mixture thereof.

The number of sulfur radicals released from the polysulfide depends on the heat resistance of the polysulfide. With respect to the heat resistance of polysulfides, primary polysulfides have highest heat resistance, and tertiary polysulfides have lowest heat resistance. Thus, primary polysulfides release more sulfur radicals at the highest temperature, and tertiary polysulfides release more sulfur radicals at the lowest temperature. The number of sulfur radicals to be released can be controlled by adjusting the sulfur content and the sulfur chain length.

From this perspective, when the polysulfide is used as an extreme-pressure agent for a metalworking fluid, a secondary polysulfide and a tertiary polysulfide are preferably mixed for stable sulfur release from a relatively low temperature region to an intermediate temperature region, and the mixing ratio of the tertiary polysulfide to the secondary polysulfide preferably ranges from 1:0.2 to 1:5, preferably 1:0.3 to 1:4, more preferably 1:1 to 1:3, on a weight ratio basis.

A sulfur-based extreme-pressure agent having the mixing ratio found in the present invention can be used to consistently release an appropriate number of sulfur radicals even in wide temperature and pressure ranges and under an external force, such as a shear force, form a stable iron sulfide film on the metal surface, and maintain load bearing performance and lubricity for extended periods.

Although polysulfides are typically produced by sulfurizing an olefin or by sulfur-crosslinking a mercaptan, polysulfides in the present invention may be produced by any method.

Polysulfides produced by sulfurizing an olefin may be hydrocarbon sulfides having at least one ethylenically unsaturated bond, which are also referred to as sulfurized olefins. Monoolefins include, but are not limited to, chain alkenes, such as isobutylene, 2-methyl-2-pentene, 2-methyl-2-butene, 2-methyl-1-butene, diisobutylene, triisobutylene, tripropylene, 1-hexene, 1-octene, 1-nonene, 1-decene, 1-dodecene, 1-tetradecene, 1-hexadecene, and 1-octadecene, and cyclic alkenes, such as cyclopentene and cyclohexene. These monoolefins may also be used as a mixture. Dienes having 4 to 10 carbon atoms include 1,3-butadiene, 2-methyl-1,3-butadiene (isoprene), 1,3-pentadiene (piperylene), cyclopentadiene, 1,5-hexadiene, cyclohexadiene, 1,6-heptadiene, cycloheptadiene, 1,7-octadiene, and cyclooctadiene. These dienes may be used alone or in combination. Sulfides thereof may be mentioned.

Polysulfides produced by sulfur-crosslinking a mercaptan include sulfides produced by reacting a mercaptan with a sulfur powder or molten sulfur in the presence of a basic catalyst, for example, dibutyl polysulfide, dipentyl polysulfide, dihexyl polysulfide, dicyclohexyl polysulfide, diheptyl polysulfide, dioctyl polysulfide, dibenzyl polysulfide, dinonyl polysulfide, didodecyl polysulfide, and diundecyl polysulfide.

<Sulfurized Fat or Oil>

Examples of the sulfurized fat or oil in the present invention include sulfides of unsaturated animal and vegetable fats and oils, such as pig fat (lard), beef tallow, fish oil, rapeseed oil, copra oil, canola oil, coconut oil, corn oil, cottonseed oil, olive oil, palm oil, peanut oil, sunflower oil, soybean oil, safflower oil, rice oil, palm oil, sesame oil, linseed oil, grape seed oil, and recovered vegetable oil. Specific examples of the sulfurized fat or oil include sulfurized lard, sulfurized rapeseed oil, sulfurized castor oil, sulfurized soybean oil, sulfurized fish oil, and sulfurized whale oil.

The sulfurized fat or oil may be a sulfurized fat or oil with a weight-average molecular weight in the range of 1000 to 100,000.

The sulfurized fat or oil probably functions to form an oil film for preventing metals from approaching each other on the metal surface. In order for the oil film to have a certain thickness and have a bulky structure to exhibit rigidity, the weight-average molecular weight must be 1000 or more, preferably 1500 or more.

The sulfurized fat or oil also must be soluble in the base oil. From this perspective, the weight-average molecular weight must be 100,000 or less, preferably 50,000 or less, more preferably 15,000 or less.

In particular, a sulfurized fat or oil with a weight-average molecular weight in the range of 1500 to 15,000 is particularly preferred because it forms an oil film with an appropriate thickness and strength on the metal surface and is highly soluble in the base oil.

When the sulfurized fat or oil is used as an additive for a metalworking fluid, such as an extreme-pressure agent, the sulfur content of the sulfurized fat or oil preferably ranges from 2% to 30% by weight, particularly preferably 5% to 20% by weight, from the perspective of good load bearing performance of the metalworking fluid.

The sulfurized fat or oil typically has a viscosity in the range of 100 to 5000 $mm^2/s$, preferably 200 to 3000 $mm^2/s$, particularly preferably 500 to 2000 $mm^2/s$, based on kinematic viscosity at 40° C., from the perspective of high compatibility with a base oil described later and ease of handling.

Any of the above sulfurized fats and oils may be used and may be used alone or in combination.

<Sulfur-Based Extreme-Pressure Agent>

A sulfur-based extreme-pressure agent according to the present invention contains a polysulfide (a) and a sulfurized fat or oil (b). The weight ratio of the polysulfide (a) to the sulfurized fat or oil (b) ranges from 1:0.1 to 1:10, preferably 1:0.2 to 1:3.

The sulfurized fat or oil in a sulfur-based extreme-pressure agent according to the present invention adsorbs to a metal surface by the action of its polar group and forms an oil film. At the time of friction between two metal surfaces, the sulfurized fat or oil forms a thick oil film and exhibits lubricity at a relatively low load on the contact surface and at low temperature. When the load increases and metals begin to contact each other, the oil film of the sulfurized fat or oil is broken by frictional heat, and the polysulfide begins to decompose and supply sulfur. Sulfur radicals produced by the decomposition react chemically with the metal surface and form a lubricant film of iron sulfide, which suppresses the seizing and wear of the metals. Due to its high sulfur supply capacity, however, the polysulfide may supply excess sulfur radicals to the metal surface and induce metal wear associated with excessive formation of an iron sulfide film. Alleviating such a concern, the sulfurized fat or oil in a particular sulfur-based extreme-pressure agent according to the present invention probably suppresses the generation of frictional heat due to the lubricity of the oil film and reduces excessive consumption of sulfur radicals due to the decomposition of the polysulfide, thereby retaining the polysulfide in the system up to higher temperature and pressure ranges. Consequently, it is assumed that excellent load bearing performance and lubricity are exhibited even in wider temperature and pressure ranges and under an external force, such as a shear force.

Various additives described below may be added as components other than the polysulfide (a) and the sulfurized fat or oil (b) to a sulfur-based extreme-pressure agent according to the present invention without adversely affecting the performance. Two or more additives may be added.

<Sulfurized Esters>

Examples of sulfurized esters include alkyl esters having 1 to 12 carbon atoms of a sulfurized fatty acid having 8 to 22 carbon atoms, more specifically, sulfurized fatty acid methyl esters.

Sulfurized esters can be produced by sulfurizing an unsaturated fatty acid ester by any method. The unsaturated fatty acid ester is produced by reacting an alcohol with an unsaturated fatty acid, such as oleic acid, linoleic acid, or a fatty acid extracted from the animal and vegetable fats and oils.

<Sulfurized Fatty Acids>

Examples of sulfurized fatty acids include sulfides of unsaturated fatty acids, such as myristoleic acid, palmitoleic acid, sapienic acid, oleic acid, elaidic acid, vaccenic acid, gadoleic acid, eicosenoic acid, erucic acid, nervonic acid, linoleic acid, eicosadienoic acid, docosadienoic acid, linolenic acid, pinolenic acid, eleostearic acid, mead acid, dihomo-γ-linolenic acid, eicosatrienoic acid, stearidonic acid, arachidonic acid, eicosatetraenoic acid, adrenic acid, bosseopentaenoic acid, osbond acid, clupanodonic acid, tetracosapentaenoic acid, docosahexaenoic acid, nisinic acid, beef tallow fatty acid, and palm kernel fatty acid.

<Other Additives>

Examples of other additives include oiliness agents, antioxidants, anticorrosives, metal deactivators, corrosion inhibitors, anti-wear agents, other extreme-pressure agents, demulsifiers, and antifoaming agents. Any one or two or more of the other additives may be added.

Examples of the oiliness agents include aliphatic saturated and unsaturated monocarboxylic acids, such as stearic acid and oleic acid; polymeric fatty acids, such as dimer acids and hydrogenated dimer acids; hydroxy fatty acids, such as ricinoleic acid and 12-hydroxystearic acid; aliphatic saturated and unsaturated monoalcohols, such as lauryl alcohol and oleyl alcohol; aliphatic saturated and unsaturated monoamines, such as stearylamine and oleylamine; aliphatic saturated and unsaturated monocarboxylic acid amides, such as lauramide and oleamide; and partial esters of a polyhydric alcohol, such as glycerin or sorbitol, and an aliphatic saturated or unsaturated monocarboxylic acid. These may be used alone or in combination. The oiliness agent content is preferably 0.01% or more by weight, more preferably 0.1% or more by weight, and preferably 10% or less by weight, more preferably 5% or less by weight, of the total amount of metalworking fluid described later.

Examples of the antioxidants include phenolic antioxidants, such as 2,6-di-tert-butyl-4-methylphenol, 2,6-di-tert-butyl-4-ethylphenol, and 2,2'-methylenebis(4-methyl-6-tert-butylphenol); amine antioxidants, such as alkylated diphenylamines, alkylated-α-naphthylamines, phenyl-α-naphthylamine, and N,N'-di-phenyl-p-phenylenediamine; and sulfur-based antioxidants, such as 2,6-di-tert-butyl-4-[4,6-bis(octylthio)-1,3,5-triazin-2-ylamino]phenol and dilauryl thiodipropionate.

The antioxidant content is preferably 0.01% or more by weight, more preferably 0.05% or more by weight, and preferably 5% or less by weight, more preferably 3% or less by weight, of the total amount of metalworking fluid described later, from the perspectives of advantages and economic efficiency.

Examples of the anticorrosives include carboxylic acids, sulfonates, phosphates, alcohols, and esters. These may be used alone or in combination. The anticorrosive content is preferably 0.01% or more by weight, more preferably 0.1% or more by weight, and preferably 10% or less by weight, more preferably 5% or less by weight, of the total amount of metalworking fluid described later.

Examples of the metal deactivators include benzotriazole metal deactivators, benzimidazole metal deactivators, benzothiazole metal deactivators, thiadiazole metal deactivators, dimercaptothiazole metal deactivators, and metal deactivators composed of N,N'-disalicylidene-1,2-diaminopropane.

The metal deactivator content is preferably 0.005% or more by weight, more preferably 0.01% or more by weight, and preferably 5% or less by weight, more preferably 3% or less by weight, of the total amount of metalworking fluid described later, from the perspectives of advantages and economic efficiency.

Examples of the corrosion inhibitors include amine corrosion inhibitors, alkanolamine corrosion inhibitors, amide corrosion inhibitors, and carboxylic acid corrosion inhibitors.

The corrosion inhibitor content is preferably 0.005% or more by weight, more preferably 0.01% or more by weight, and preferably 5% or less by weight, more preferably 3% or less by weight, of the total amount of metalworking fluid described later, from the perspectives of advantages and economic efficiency.

Examples of the anti-wear agents include phosphorus-based anti-wear agents, such as phosphate ester anti-wear agents, acidic phosphate ester anti-wear agents, phosphite ester anti-wear agents, acidic phosphite esters, and amine salts thereof.

Examples of the other extreme-pressure agents include metal salts of carboxylic acids. The metal salts of carboxylic acids are preferably metal salts of carboxylic acids having 3 to 60 carbon atoms, more preferably metal salts of fatty acids having 3 to 30 carbon atoms, still more preferably metal salts of fatty acids having 12 to 30 carbon atoms. Metal salts of dimer acids, trimer acids, and dicarboxylic acids having 3 to 30 carbon atoms are also mentioned. Among these, the metal salts of carboxylic acids are preferably metal salts of fatty acids having 12 to 30 carbon atoms and metal salts of dicarboxylic acids having 3 to 30 carbon atoms.

Examples of the demulsifiers include surfactants, such as anionic surfactants, cationic surfactants, and nonionic surfactants. The demulsifier content preferably ranges from 0.001% to 0.5% by weight of the total amount of metalworking fluid described later.

Examples of the antifoaming agents include silicone antifoaming agents, such as silicone oils, fluorinated silicone antifoaming agents, such as fluorosilicone oils, and polyacrylate antifoaming agents. The antifoaming agent content is preferably 0.0001% or more by weight, more preferably 0.0005% or more by weight, and preferably 0.5% or less by weight, more preferably 0.01% or less by weight, of the total amount of metalworking fluid described later.

A sulfur-based extreme-pressure agent according to the present invention, which contains the polysulfide (a) and the sulfurized fat or oil (b), is suitably used in metalworking applications, such as cutting, grinding, and deformation processing, and in addition to metalworking fluid applications can also be used as an extreme-pressure agent, for example, for an automotive lubricating oil for use in internal combustion engines, driving equipment, such as automatic transmissions, buffers, and power steering, gears, and greases, or for a hydraulic fluid, which is a power transmission fluid for use in power transmission, force control, and buffer operations in hydraulic systems, such as hydraulic machines and equipment.

<Metalworking Fluid>

A metalworking fluid according to the present invention is composed of a sulfur-based extreme-pressure agent and an arbitrary amount of base oil (c). The base oil (c) is not limited in any way and may be appropriately selected from mineral oils and synthetic oils in accordance with the intended use and the conditions of use. Examples of the mineral oils include distillate oil produced by atmospheric distillation of paraffinic or naphthenic crude oil or by vacuum distillation of a residue after atmospheric distillation and refined oil produced by solvent purification, hydrogenation purification, dewaxing treatment, or clay treatment of the distillate oil. Examples of the synthetic oils include low-molecular-weight polybutene, low-molecular-weight polypropylene, α-olefin oligomers having 8 to 14 carbon atoms, and hydrides thereof, polyol esters, such as fatty acid esters of trimethylolpropane and fatty acid esters of pentaerythritol, ester compounds, such as dibasic acid esters, aromatic polycarboxylates, and phosphates, alkyl aromatic compounds, such as alkylbenzenes and alkylnaphthalenes, polyglycol oil, such as poly(alkylene glycol), and silicone oil. These may be used alone or in combination.

A metalworking fluid according to the present invention is composed of a sulfur-based extreme-pressure agent and an arbitrary amount of base oil. The sulfur-based extreme-pressure agent content of the metalworking fluid is typically, but not limited to, in the range of 1% to 100% by weight, preferably 50% or less by weight, particularly preferably 15% or less by weight.

The metalworking fluid is not particularly limited, provided that the metalworking fluid contains the sulfur-based extreme-pressure agent and the base oil. For example, the following additives may be used in combination depending on the intended use and performance: an oiliness agent, an anti-wear agent, another extreme-pressure agent, an anticorrosive, a corrosion inhibitor, an antifoaming agent, a cleaning/dispersing agent, a pour-point depressant, a viscosity index improver, an antioxidant, an emulsifier, a demulsifier, a fungicide, a friction modifier, and a surfactant.

The following are specific examples of various additives. The oiliness agent may be a long-chain fatty acid (oleic acid), examples of which include stearic acid, oleic acid, dimer acid, hydrogenated dimer acid, ricinoleic acid, 1,2-hydroxystearic acid, lauryl alcohol, oleyl alcohol, stearylamine, oleylamine, lauramide, oleamide, glycerin, and sorbitol. The anti-wear agent may be a metal dithiophosphate salt. The extreme-pressure agent may be an organosulfur compound, an organophosphorus compound, an organic halide, or a metal salt of a carboxylic acid. The metal salt of the carboxylic acid is preferably a metal salt of a carboxylic acid having 3 to 60 carbon atoms, more preferably a metal salt of a fatty acid having 3 to 30 carbon atoms, still more preferably a metal salt of a fatty acid having 12 to 30 carbon atoms. Metal salts of dimer acids and trimer acids of the fatty acids and metal salts of dicarboxylic acids having 3 to 30 carbon atoms are also mentioned. The other anticorrosive may be an amine, an alkanolamine, an amide, a carboxylic acid, or an ester. The corrosion inhibitor may be a nitrogen compound (benzotriazole, etc.), for example, a compound containing sulfur and nitrogen (1,3,4-thiadiazolyl-2,5-bisdialkyl dithiocarbamate), a benzotriazole compound, a benzimidazole compound, a benzothiazole compound, a thiadiazole compound, or a dimercaptothiazole compound. The antifoaming agent may be silicone oil, a metallic soap, a fatty acid ester, or a phosphate ester. The cleaning/dispersing agent may be a neutral or basic sulfonate or phenate (metal salt form), succinimide, an ester, or a benzylamine copolymer. The pour-point depressant may be a condensate of chlorinated paraffin and naphthalene or phenol, a polyalkyl acrylate or methacrylate, polybutene, a polyalkylstyrene, or poly(vinyl acetate). The viscosity index improver may be a polymethacrylate, polyisobutylene, an olefin copolymer, or a polyalkylstyrene. The antioxidant may be an amine, hindered phenol, zinc thiophosphate, or a trialkyl phenol. The emulsifier may be a sulfate, a sulfonate, a phosphate, a fatty acid derivative, an amine derivative, a quaternary ammonium salt, or a polyoxyethylene activator. The demulsifier may be a quaternary ammonium salt, a sulfonated oil, or a phosphate ester. The fungicide may be a phenolic compound, a formaldehyde donor compound, or a salicylanilide compound.

The metalworking fluid may contain one or more selected from the group consisting of phosphate ester compounds and amine salts thereof. The phosphate ester probably functions as not only an anti-wear agent but also an extreme-pressure agent. Thus, the metalworking fluid can have good extreme-pressure performance due to the combination of the polysulfide (a) and the sulfurized fat or oil (b)

Examples of the phosphate ester include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethyl phenyl diphenyl phosphate, diethyl phenyl phenyl phosphate, propyl phenyl diphenyl phosphate, dipropyl phenyl phenyl phosphate, triethyl phenyl phosphate, tripropyl phenyl phosphate, butyl phenyl diphenyl phosphate, dibutyl phenyl phenyl phosphate, tributyl phenyl phosphate, trihexyl phosphate, tri(2-ethylhexyl) phosphate, tridecyl phosphate, trilauryl phosphate, trimyristyl phosphate, tripalmityl phosphate, tristearyl phosphate, trioleyl phosphate, alkyl phenyl phenyl phosphates, and polyoxyethylene monoalkyl ether phosphates.

Examples of acidic phosphate esters include monoethyl acid phosphate, mono-n-propyl acid phosphate, mono-2-ethylhexyl acid phosphate, monobutyl acid phosphate, monooleyl acid phosphate, monotetracosyl acid phosphate, monoisodecyl acid phosphate, monolauryl acid phosphate, monotridecyl acid phosphate, monostearyl acid phosphate, monoisostearyl acid phosphate, diethyl acid phosphate, di-n-propyl acid phosphate, di-n-butyl acid phosphate, di-2-ethylhexyl acid phosphate, dioleyl acid phosphate, ditetracosyl acid phosphate, diisodecyl acid phosphate, dilauryl acid phosphate, ditridecyl acid phosphate, distearyl acid phosphate, and diisostearyl acid phosphate.

Examples of the phosphite esters include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, and trioleyl phosphite.

Examples of the acidic phosphite esters include monoethyl hydrogen phosphite, mono-n-propyl hydrogen phosphite, mono-n-butyl hydrogen phosphite, mono-2-ethylhexyl hydrogen phosphite, monolauryl hydrogen phosphite, monooleyl hydrogen phosphite, monostearyl hydrogen phosphite, monophenyl hydrogen phosphite, dibutyl hydrogen phosphite, dihexyl hydrogen phosphite, diheptyl hydrogen phosphite, di-n-octyl hydrogen phosphite, di-2-ethylhexyl hydrogen phosphite, dilauryl hydrogen phosphite, dioleyl hydrogen phosphite, distearyl hydrogen phosphite, and diphenyl hydrogen phosphite.

Among these phosphate ester compounds, alkyl phenyl phenyl phosphates and polyoxyethylene monoalkyl ether phosphates are preferred.

The phosphate ester content of the metalworking fluid is such that the weight ratio S/P (SP ratio) of the amount of sulfur S derived from the sulfur-based extreme-pressure agent to the amount of phosphorus P derived from the phosphate ester in the metalworking fluid preferably ranges from 0.1 to 300, more preferably 1 to 200, particularly preferably 10 to 150. At S/P in the above range, the sulfur-based extreme-pressure agent and the phosphate ester function synergistically and improve the extreme-pressure performance.

The S/P can be calculated using [the sum total of (the concentration of each sulfur-based extreme-pressure agent in the metalworking fluid×the sulfur content of the sulfur-based extreme-pressure agent)]/[the sum total of (the concentration of each phosphate ester in the metalworking fluid×the phosphorus content of the phosphate ester)].

In the production of a metalworking fluid according to the present invention, the extreme-pressure agent, various additives, and the base oil may be added in any order by any method. The extreme-pressure agent and the additives may be added to the base oil, or a mixture of the extreme-pressure agent and the additives prepared in advance may be added to the base oil. When a plurality of additives are added, a mixture of the additives may be prepared in advance. When an additive mixture containing a phosphorus compound as an additive is prepared, the phosphorus compound is preferably added lastly to suppress side reactions.

A typical characteristic of an extreme-pressure agent and a metalworking fluid according to the present invention is weld load. The weld load is originally used to evaluate the degree of melting and adhesion of contact surfaces of metals during friction and is used to measure the load at which the metals weld together when the load is increased while one metal is pressed against the other rotating metal. In metalworking fluid applications, the weld load is widely used as a technique for evaluating load bearing performance and extreme-pressure performance.

EXAMPLES

Although the present invention is described in detail in the following examples, the present invention is not limited to these examples. Unless otherwise specified, "parts" and "%" are based on weight. The scope of the present invention is not limited to these examples. The physical properties and molecular weight distribution, an extreme-pressure performance test (a high-speed four-ball test), and the molecular weight (the degree of polymerization) of polysulfides were measured by the following methods under the following conditions. The weld load was measured with a high-speed four-ball EP testing machine in accordance with ASTM D2783 at room temperature and at 1770 rpm for 10 seconds.

Molecular weight (degree of polymerization): GPC HLC-8120 GPC UV-8020 manufactured by Tosoh Corporation Column: manufactured by Tosoh Corporation
TSK guard column HXL 6.0 mm I.D.×4 cm
TSK gel-G 4000 HXL 7.8 mm I.D.×30 cm
TSK gel-G 3000 HXL 7.8 mm I.D.×30 cm
TSK gel-G 2000 HXL 7.8 mm I.D.×30 cm
TSK gel-G 1000 HXL 7.8 mm I.D.×30 cm
Solvent THF
No gradient
Flow rate 1 ml/min
Pump pressure 7.8 MPa on the sample side
10.5 MPa on the reference side
Column temperature 40° C.
Injection volume 100 μl
UV wavelength 254 nm Extreme-pressure performance test (high-speed four-ball test): weld load, maximum non-seizing load, and wear track diameter were measured in accordance with ASTM D-2783.

Base oil: 150 neutral oil (29 $mm^2/s$ at 40° C.)

Vertical shaft rotational speed: 1770 rpm

Test steel ball: ½ inches for ball bearing (JIS Advanced)

Measurement time for weld load and maximum non-seizing load: 10 seconds

Example 1

750 g of a secondary polysulfide and 250 g of a sulfurized animal fat or oil with a weight-average molecular weight MW=11,000 were weighed in a 1-L glass beaker. While the mixture was heated on a hot plate at a temperature of 50° C., the mixture was stirred at 350 rpm for 30 minutes using a Three-One Motor equipped with a SUS anchor-type impeller blade. An extreme-pressure agent thus prepared was added to the base oil and was diluted to prepare a metalworking fluid 1.

Examples 2 to 5, Comparative Examples 1 to 6

Metalworking fluids 2 to 5 and metalworking fluids 11 to 16 were prepared in the same manner as in Example 1 on the basis of the formulations (% by weight) shown in Tables 1 and 2.

Example 6

A metalworking fluid 6 was prepared in the same manner as in Example 1 except that 750 g of the secondary polysulfide was replaced by 500 g of a secondary polysulfide and 250 g of a tertiary polysulfide.

Examples 7 to 9

Metalworking fluids 7 to 9 were prepared in the same manner as in Example 6 on the basis of the formulation shown in Table 1.

Example 10

485 g of a secondary polysulfide, 242.5 g of a tertiary polysulfide, and 242.5 g of a sulfurized animal fat or oil with a weight-average molecular weight MW=11,000 were weighed in a 1-L glass beaker. While the mixture was heated on a hot plate at a temperature of 50° C., the mixture was stirred at 350 rpm for 30 minutes using a Three-One Motor equipped with a SUS anchor-type impeller blade. Subsequently, 15 g of an alkyl phenyl phenyl phosphate and 15 g of a polyoxyethylene monoalkyl ether phosphate were added and were stirred at 350 rpm for 30 minutes using a Three-One Motor equipped with a SUS anchor-type impeller blade. An extreme-pressure agent thus prepared was added to the base oil and was diluted to prepare a metalworking fluid 10. The S/P was 140.

Reference Example 242.5 g of a secondary polysulfide, 242.5 g of a tertiary polysulfide, and 485 g of a sulfurized vegetable fat or oil with a weight-average molecular weight MW=5000 were weighed in a 1-L glass beaker. While the mixture was heated on a hot plate at a temperature of 50° C., the mixture was stirred at 350 rpm for 30 minutes using a Three-One Motor equipped with a SUS anchor-type impeller blade. Subsequently, 15 g of an alkyl phenyl phenyl phosphate and 15 g of a polyoxyethylene monoalkyl ether phosphate were added and were stirred at 350 rpm for 30 minutes using a Three-One Motor equipped with a SUS anchor-type impeller blade. An extreme-pressure agent thus prepared was added to the base oil and was diluted to prepare a metalworking fluid 17. The S/P was 120.

Example 11

237.5 g of a secondary polysulfide, 237.5 g of a tertiary polysulfide, and 475 g of a sulfurized vegetable fat or oil with a weight-average molecular weight MW=5000 were weighed in a 1-L glass beaker. While the mixture was heated on a hot plate at a temperature of 50° C., the mixture was stirred at 350 rpm for 30 minutes using a Three-One Motor equipped with a SUS anchor-type impeller blade. Subsequently, 50 g of an alkyl phenyl phenyl phosphate was added and was stirred at 350 rpm for 30 minutes using a Three-One Motor equipped with a SUS anchor-type impeller blade. An extreme-pressure agent thus prepared was added to the base oil and was diluted to prepare a metalworking fluid 18. The S/P was 50.

The performance of the metalworking fluids was evaluated. Tables 1 and 2 show the evaluation results.

TABLE 1

| | | | | Example 1 Metal-working fluid 1 | Example 2 Metal-working fluid 2 | Example 3 Metal-working fluid 3 | Example 4 Metal-working fluid 4 | Example 5 Metal-working fluid 5 | Example 6 Metal-working fluid 6 | Example 7 Metal-working fluid 7 | Example 8 Metal-working fluid 8 | Example 9 Metal-working fluid 9 |
|---|---|---|---|---|---|---|---|---|---|---|---|---|
| Composition | Sulfur-based extreme-pressure agent (wt %) | | | 10 | 10 | 10 | 10 | 10 | 10 | 10 | 10 | 10 |
| | Components | Polysulfide | Secondary polysulfide | 75 | — | — | — | — | 50 | 50 | 50 | 50 |
| | | | Tertiary polysulfide | — | 75 | 75 | 75 | 75 | 25 | 25 | 25 | 25 |
| | | Sulfurized fat or oil | Sulfurized animal fat or oil A (MW = 11000) (Sulfurized lard) | 25 | 25 | — | — | — | 25 | — | — | — |
| | | | Sulfurized animal fat or oil B (MW = 10000) (Sulfurized lard) | — | — | 25 | — | — | — | 25 | — | — |

TABLE 1-continued

| | | | | Example 1 Metal-working fluid 1 | Example 2 Metal-working fluid 2 | Example 3 Metal-working fluid 3 | Example 4 Metal-working fluid 4 | Example 5 Metal-working fluid 5 | Example 6 Metal-working fluid 6 | Example 7 Metal-working fluid 7 | Example 8 Metal-working fluid 8 | Example 9 Metal-working fluid 9 |
|---|---|---|---|---|---|---|---|---|---|---|---|---|
| | | | Sulfurized vegetable fat or oil C (MW = 5000) (Sulfurized recovered vegetable oil) | — | — | — | 25 | — | — | — | 25 | — |
| | | | Sulfurized vegetable fat or oil D (MW = 2000) (Sulfurized canola | — | — | — | — | 25 | — | — | — | 25 |
| | | Phosphate ester | Alkyl phenyl phenyl phosphate | — | — | — | — | — | — | — | — | — |
| | | | Polyoxyethylene monoalkyl ether phosphate | — | — | — | — | — | — | — | — | — |
| | Base oil (wt %) Mineral oil 150N | | | 90 | 90 | 90 | 90 | 90 | 90 | 90 | 90 | 90 |
| | Total | | | 100 | 100 | 100 | 100 | 100 | 100 | 100 | 100 | 100 |
| Characteristics | Weld load | | ASTM D2783 (N) | 5200 | 5900 | 6500 | 6200 | 6400 | 7200 | 7400 | 6600 | 7200 |

TABLE 2

| | | | | Example 10 Metal-working fluid 10 | Comparative example 1 Metal-working fluid 11 | Comparative example 2 Metal-working fluid 12 | Comparative example 3 Metal-working fluid 13 | Comparative example 4 Metal-working fluid 14 | Comparative example 5 Metal-working fluid 15 | Comparative example 6 Metal-working fluid 16 | Reference example 1 Metal-working fluid 17 | Example 11 Metal-working fluid 18 |
|---|---|---|---|---|---|---|---|---|---|---|---|---|
| Composition | Sulfur-based extreme-pressure agent (wt %) | | | 5 | 10 | 10 | 10 | 10 | 10 | 10 | 5 | 5 |
| | Components | Polysulfide | Secondary polysulfide | 48.5 | 100 | — | — | — | — | — | 24.25 | 23.75 |
| | | | Tertiary polysulfide | 24.25 | — | 100 | — | — | — | — | 24.25 | 23.75 |
| | | Sulfurized fat or oil | Sulfurized animal fat or oil A (MW = 11000) (Sulfurized lard) | 24.25 | — | — | 100 | — | — | — | — | — |
| | | | Sulfurized animal fat or oil B (MW = 10000) (Sulfurized lard) | — | — | — | — | 100 | — | — | — | — |
| | | | Sulfurized vegetable fat or oil C (MW = 5000) (Sulfurized recovered vegetable oil) | — | — | — | — | — | 100 | — | 48.5 | 47.5 |
| | | | Sulfurized vegetable fat or oil D (MW = 2000) (Sulfurized canola oil) | — | — | — | — | — | — | 100 | — | — |
| | | Phosphate ester | Alkyl phenyl phenyl phosphate | 1.5 | — | — | — | — | — | — | 1.5 | 5 |
| | | | Polyoxyethylene monoalkyl ether phosphate | 1.5 | — | — | — | — | — | — | 1.5 | — |
| | Base oil (wt %) Mineral oil 150N | | | 95 | 90 | 90 | 90 | 90 | 90 | 90 | 95 | 95 |
| | Total | | | 100 | 100 | 100 | 100 | 100 | 100 | 100 | 100 | 100 |
| Characteristics | Weld load | | ASTM D2783 (N) | 11000 | 2900 | 2900 | 3900 | 3900 | 4500 | 5000 | 4900 | 6100 |

It can be seen that the metalworking fluids of Examples 1 to 5, which contained a particular polysulfide and a particular sulfurized fat or oil, have a higher weld load and are better than the metalworking fluids of Comparative Examples 1 to 6, which contained only one of the polysulfide and the sulfurized fat or oil.

It can be seen that due to the use of the polysulfide in combination with the secondary polysulfide and the tertiary polysulfide the metalworking fluids of Examples 6 to 9 have a higher weld load and are excellent as metalworking fluids.

It can also be seen that Examples 10 and 11, which contained a phosphate ester, have a high weld load in spite of a small amount of extreme-pressure agent relative to the metalworking fluid and are particularly excellent as metalworking fluids.

The invention claimed is:

1. A sulfur-based extreme-pressure agent comprising a polysulfide (a) represented by the following formula (1) and a sulfurized fat or oil (b) at a weight ratio in the range of 1:0.1 to 1:10, $$R^1—S_x—R^2 \quad (1)$$

wherein $R^1$ and $R^2$ denote an alkyl or alkenyl group having 2 to 24 carbon atoms, and x denotes an integer in the range of 1 to 8, and wherein the polysulfide (a) comprises a tertiary polysulfide having the tertiary alkyl or alkenyl group as $R^1$ and $R^2$ and a secondary polysulfide having the secondary alkyl or alkenyl group as $R^1$ and $R^2$, a weight ratio of the tertiary polysulfide to the secondary polysulfide being in the range of 1:0.2 to 1:2, wherein a total amount of the tertiary polysulfide and the secondary polysulfide in the sulfur-based extreme-pressure agent is at least 47.5% by weight, wherein the secondary polysulfide is bisdecen-2-yl polysulfide, wherein the tertiary polysulfide is bis-2,4,4-trimethylpentan-2-yl polysulfide, and wherein the sulfurized fat or oil (b) is selected from the group consisting of sulfurized lard, sulfurized recovered vegetable oil, and sulfurized canola oil.

2. The sulfur-based extreme-pressure agent according to claim 1, wherein the sulfurized fat or oil (b) has a weight-average molecular weight in the range of 1000 to 100,000.

3. A metalworking fluid comprising 1% to 100% by weight of the sulfur-based extreme-pressure agent according to claim 1.

4. The sulfur-based extreme-pressure agent according to claim 1, the secondary polysulfide and the tertiary polysulfide contain a sulfur in an amount of from 10% to 60% by weight.

5. The sulfur-based extreme-pressure agent according to claim 1, wherein the sulfurized fat or oil (b) has a weight-average molecular weight in the range of 2000 to 11,000.

* * * * *